United States Patent [19]

Winters et al.

[11] Patent Number: 4,532,006

[45] Date of Patent: Jul. 30, 1985

[54] INORGANIC FIBER MAT USING MINERAL WOOL AND RELATED PROCESS AND APPARATUS

[75] Inventors: Donald C. Winters, Irving, Tex.; Ivan D. Klein, Westford, N.Y.

[73] Assignee: The Flintkote Company, Stamford, Conn.

[21] Appl. No.: 520,842

[22] Filed: Aug. 5, 1983

[51] Int. Cl.[3] ..... C03B 37/00

[52] U.S. Cl. ..... 162/3; 162/13; 162/55; 162/145; 162/152; 162/156

[58] Field of Search ..... 162/3, 152, 156, 101, 162/4, 13, 145, 55; 65/9, 10; 209/163, 164, 165, 169, 170

[56] References Cited

U.S. PATENT DOCUMENTS

| | | | |
|---|---|---|---|
| 1,865,049 | 6/1932 | Shaver | 162/152 |
| 2,772,157 | 11/1956 | Cilley et al. | 162/145 |
| 3,015,582 | 1/1962 | Simison | 162/145 |
| 3,228,825 | 1/1966 | Waggoner | 162/101 |
| 3,418,203 | 12/1968 | Asunmaa | 162/145 |
| 3,622,445 | 11/1971 | Heidweiller | 162/145 |
| 4,072,558 | 2/1978 | Akerson | 162/145 |
| 4,097,644 | 6/1978 | Evensen et al. | 162/145 |
| 4,153,503 | 5/1979 | Booth et al. | 162/145 |
| 4,200,487 | 4/1980 | Bondoc et al. | 162/156 |
| 4,220,500 | 9/1980 | Baba et al. | 162/145 |
| 4,234,379 | 11/1980 | Conway et al. | 162/152 |
| 4,248,664 | 2/1981 | Atkinson et al. | 162/145 |
| 4,251,320 | 2/1981 | Cederqvist et al. | 162/152 |
| 4,254,823 | 3/1981 | Cederqvist et al. | 162/152 |
| 4,258,098 | 3/1981 | Bondoc et al. | 162/156 |
| 4,284,470 | 8/1981 | Bondoc | 162/156 |

*Primary Examiner*—Peter Chin

*Attorney, Agent, or Firm*—Brumbaugh, Graves, Donohue & Raymond

[57] ABSTRACT

An improved inorganic fiber mat containing mineral wool, preferably a composite mat of mineral wool and fiberglass, is prepared by:

(a) forming an aqueous slurry of the inorganic fiber raw material containing non-fibrous, particulate contaminants;

(b) agitating the slurry to separate heavier contaminant materials;

(c) passing the slurry through a unique cleaning apparatus whereby the moving slurry is cascaded and subjected to air induced hydraulic turbulence to separate any remaining contaminant materials; and (d) thereafter transferring the fibrous material, preferably as an admixture of cleaned mineral wool fibers and glass fibers, to a mat forming device.

3 Claims, 6 Drawing Figures

INORGANIC FIBER MAT USING MINERAL WOOL AND RELATED PROCESS AND APPARATUS

BACKGROUND OF THE INVENTION

This invention relates to an improved inorganic fiber mat useful inter alia as a felt for roofing products, such as asphalt shingles. The invention further relates to a process and apparatus for making such an inorganic fiber mat or sheet containing mineral wool or a combination of mineral wool and other fibers, such as fiberglass, whereby greatly improved properties are attained by use of a novel cleaning system for the mineral wool fiber.

In recent years, there has been a marked increase in the use of inorganic fiberglass mat in place of the conventional organic felt base, made traditionally of cellulosic fibers, in the preparation of roof and floor sealing products. The terms "fiberglass" and "glass fiber", as used herein, refer to fibers of silica materials which are formed through an extrusion process. Such fibers are generally of uniform diameter and relatively free of non-fibrous contaminants. In order to form a fiberglass mat, a "wet-laid" process is often used whereby the glass fibers are mixed with water to form a relatively thick slurry, which is then fed to a dispersion tank. The slurry is diluted in the dispersion tank with water, and optionally with a small quantity of a dispersing agent to facilitate the separation of the fibers. The slurry is mixed in the dispersion tank to form a relatively uniform mixture. The mixture is pumped to a head box, which lays a uniform dispersion on a moving screen to form the glass mat. Water is suctioned through the forming wire into the machine white water tank, from which it is recycled in the process. Unlike cellulosic fibers which are self-adhering upon wetting, glass or any inorganic fibers require an organic resin binder to form a mat useful for conversion into roofing products. As such, the glass or inorganic fiber layer as formed on the screen is thereafter impregnated with a binder, such as a urea formaldehyde or a urea formaldehyde-latex blend. Other binder systems can be used as needed for various products selected by those skilled in the art.

While fiberglass does produce a fiber mat having excellent tensile strength, flexibility, and dimensional stability, glass fiber is relatively expensive to manufacture, especially in view of recent increases in the cost of energy. It would, therefore, be desirable to utilize substitute inorganic raw materials which can be fiberized and have characteristics similar to those of fiberglass, but which are less costly. It has long been known that mineral fibers can be prepared from various silicate based inorganic raw materials using a process in which the raw material in molten form is "blown" or "spun" into fibers. These products are commonly referred to as "mineral wool", which is a generic term for various mineral fibrous materials commonly known as "rock wool", "slag wool" and "glass wool". Rock wool is made from natural rock or combinations of natural minerals; slag wool is derived from iron, copper or lead blast furnace slag; and glass wool is made from conventional glass batch materials such as silica, sand, soda ash or borax, dolomite, and minor ingredients.

While mineral wool is prepared in a fibrous form, its applications are limited as compared with fiberglass since by known methods for preparing mineral wool, it has a substantial content of non-fibrous contaminants in the form of grit, sand, large shot, and fines. Typical mineral wool contains up to about 30–60% of such contaminants. In addition, the fibers themselves have random diameter distribution and tend to have pieces of shot adhered at the end of the fibers.

The non-fibrous or particulate contaminant materials are undesirable because they reduce the mechanical strength of the mineral wool. Moreover, the particulate material can be so fine as to become air-borne as dust, and become distributed over a wide area. Since the dust can cause skin irritation and other injuries, particularly if inhaled, this can pose a considerable problem during conversion of mineral wool into other useful products. Consequently, it is desirable that the non-fibrous contaminants be removed, but this has heretofore been difficult to accomplish. Since the contaminant material is made of the same material as the fibers, the contaminants cannot be dissolved out, nor does a sufficient amount of the contaminants have a different density as compared to the fibrous material which would facilitate satisfactory separation by other techniques. Moreover, the brittleness of the fiber precludes any relatively rough treatment which might cause the fibers to be crushed, broken or otherwise destroyed.

Accordingly, the relatively "dirty" mineral wool heretofore known in the art is at best a poor substitute for glass fiber, and, as such, its primary use has been in batt form as insulation. Prior attempts to incorporate mineral wool in anything but a minor proportion in other fibrous based products, such as roofing felt, have been unsatisfactory. More specifically, with regard to roofing products, the large proportion of shot and other contaminants (which are of a different configuration than the fiber), as well as the relatively brittle nature of the fibers, result in a mat or sheet having a lower tensile strength since the adhered shot in the fiber portion causes an overall weakening. In a conventional commercial wet-laid process for preparing a mat from mineral wool, the high degree of contaminants interferes with the binder such that proper bonding of the fibers is not satisfactorily achieved. The non-fibrous contaminants are carried along with the machine water during recycling and foul the processing equipment, particularly the mat forming wire or screen, thus necessitating frequent shut downs, cleaning, and equipment maintenance.

Numerous attempts have been made to refine or clean mineral wool so as to separate and remove the non-fibrous contaminants from the raw fiber. No prior process or method has been entirely satisfactory or commercially acceptable, particularly for producing mineral wool fibers suitable as a satisfactory fiberglass substitute. These prior methods have included a wide range of separation processes, equipment and techniques based upon simple mechanical agitation, washing, a gaseous fluid bed or stream, a gas cyclone and various combinations thereof. Typical prior art techniques are described in U.S. Pat. Nos. 3,055,498; 3,111,719; 3,142,869; 3,308,945; 3,865,315; 4,229,285; 4,268,294; 4,269,701. These so-called "cleaning" processes for mineral wool as known in the art include both "dry" and "wet" cleaning apparatus. In a dry process, a high proportion of the useable fibers can be lost, rendering such a process uneconomical. In addition, there are various environmental hazards to be considered, since most processes involve spinning the fibers in air. In the various known processes for wet cleaning of mineral wool, the fibers are suspended in an aqueous medium, which is agitated such that the fibers tend to rise and the shot and other particulate contaminants, due to differences in relative surface area vis-a-vis the fiber, tend to settle. Such processes often incorporate various abrading means so as to attempt to break off the "adhered" shot from the ends of the fiber, and thereby produce a cleaner fibrous material. Substantial quantities of the fiber are often lost by this technique. In addition, in many of the prior wet processes, when the cleaned mineral wool is recovered and dried, it is difficult, when re-slurrying, to achieve a separation of the fibers. The fibers instead tend to intertwine and remain in clumps.

Accordingly, it is an object of this invention to provide an improved inorganic fiber mat, and in particular a mat containing mineral wool fibers, which is sufficiently and substantially free of non-fibrous contaminants.

It is also an object of this invention to provide an inorganic fiber mat containing mineral wool which is an acceptable fiberglass substitute in the manufacture of mat and sheet materials suitable for use inter alia as roofing felt or otherwise as a sealing membrane for building and other industrial uses.

It is a further object of this invention to provide a method and apparatus for the effective separation and removal of non-fibrous contaminants from inorganic fibrous material at minimal cost and without any substantial fiber damage or diminution of the physical properties of the fiber.

SUMMARY OF THE INVENTION

In accordance with the present invention, an inorganic fiber mat containing mineral wool is prepared which is substantially free of the non-fibrous and particulate loose contaminants heretofore experienced in the manufacture of a mineral wool fiber mat. While the fiber mat according to the invention may comprise any inorganic raw material which can be suitably drawn to a fibrous form, the invention is preferably a composite comprising glass fiber and mineral wool fiber. The fibrous mat or sheet products of the invention are characterized by excellent overall physical properties, similar to those of an expensive fiberglass mat, including good tensile strength, flexibility and dimensional stability.

It has now been found that through the apparatus and processing techniques according to the invention, as will be hereinafter described in detail, ordinary mineral wool containing substantial amounts of non-fibrous contaminants may be successfully employed in preparing an inorganic fiber mat suitable for a variety of end uses in the building products field as well as other industries. Through the use of a novel cleaning system, including a unique air-induced hydraulic tumbling and baffle device, the loose, non-fibrous contaminants normally found in mineral wool fiber are substantially removed and separated without any appreciable fiber loss or diminution of advantageous properties and fiber characteristics. Moreover, the drawbacks previously experienced in the use of mineral wool have been effectively eliminated, such that a relatively inexpensive, yet high grade, inorganic fiber is now available.

The present invention, therefore, comprises a novel inorganic mat structure, as well as a novel process for forming an inorganic fiber mat. More particularly, it has been found that by using the apparatus and process of the invention, relatively large percentages of mineral wool fiber may be substituted for glass fiber in making a mat suitable for use as a substrate for roofing shingles. In addition, by incorporating the cleaning procedures in accordance with the invention, roofing shingle mat having a substantial proportion of mineral wool fibers substituted for fiberglass may be formed in a continuous wet-laid process.

In accordance with the present invention, the mat or sheet forming process is divided into a unique pre-processing stage, including a mineral wool cleaning system, followed by a conventional forming stage. In the pre-processing stage or section, bales of mineral wool are fed into a dispersion tank to form a dilute dispersion or slurry of mineral wool in water. The aqueous slurry in the dispersion tank is agitated mechanically under relatively mild conditions, so as to effect a partial separation of the fibers and loose shot, particularly the heavy shot material, which settles to the bottom. The slurry is fed in a flowstream which directs the water-fiber from the dispersion tank into the cleaning apparatus. At such time, the heavy shot has been separated due to differences in density or physical configuration, since the fibers tend to float because of their large relative surface area as compared with the heavier particulate matter.

The aqueous slurry of mineral wool fibers is fed from the dispersion tank into a cleaning apparatus. At this point, the slurry includes, in addition to the fibers, small size contaminants, which are sometimes referred to as "grit". In addition, portions of "adhered" shot may remain on the ends of fibers, since the degree of agitation in the dispersion tank is controlled so as not to cause breakage of the fibers. In the cleaning section, the slurry is fed through a flow path, in which it encounters a number of air tumblers and baffles, which cause the slurry to move through a cascaded baffle arrangement under a slow air turbulence as it passess through the cleaning system. The flowing means causes the moving slurry to change direction a number of times, and impinge repeatedly against metal, preferably steel, surfaces. It has been found that the small grit particles tend to adhere to the metal surface as the flow passes through the cleaning apparatus. The flow rate is adjusted so as to leave the particles of grit behind as the mixture traverses the various passages in the cleaning apparatus.

The cleaned fibrous material is thereafter directed into a surge tank, which in effect acts as a holding tank and buffer. The consistency of the slurry is monitored in the surge tank, and the amount of liquid is adjusted as needed such that the fiber density of the slurry in the surge tank remains constant within a desired range. The mineral wool fiber slurry may then be pumped directly to a head box, and deposited on a moving wire so as to form a continuous mat.

In a preferred embodiment according to the invention, a composite mat of both glass fiber and cleansed mineral wool fiber is prepared by the invention process including separate pre-processing stages for the different fibrous materials prior to admixture in any derived predetermined proportion. In this embodiment, the pre-processing for treatment of the mineral wool is operated simultaneously with a pre-processing of the glass fiber wherein, in accordance with conventional practice, the fiberglass is introduced into a dispersion tank in which an aqueous slurry is formed. The slurry is fed into a further dispersion tank to effect an optimum separation of the fiberglass fibers, which are then in condition to be useable in forming glass mat. This slurry is fed to the intake side of a fan pump. The mineral wool surge tank is also connected to the intake side of the fan pump, such that mixtures of both the mineral wool and glass fiber components are drawn in simultaneously by the suction action of the pump. The delivery pipes from the feeding sections of the two components are arranged such that a desired ratio of fiberglass to mineral wool fibers is drawn into the fan pump for mixing. Dilution water is also fed into the intake side of the fan pump, such that the combined mixture of fiberglass and wool fibers, at the desired ratio, is further diluted to a consistency optimum for the head box. The fan pump in a conventional manner delivers the combined mixture to a head box which, through a wet-laid process, forms a mat on a moving screen. Water is drawn through the screen and returned for recycling in the system.

The resultant fiberglass mineral wool mat has a composition of a selected, predetermined ratio of fiberglass and cleaned mineral wool. As described above, the cleaning process is not designed to break the fibers, so as to attempt to separate adhered shot from the mineral wool, although some separation will inevitably occur. It has been found, however, that the retention of such shot does not materially interfere with the formation of an acceptable mat for roofing shingle purposes because the shot is part of the fiber and not free to disturb sheet formation nor bond formation when the binder is added to the formed wet mat. The adhered unfiberized portion comprises very small particles within the processing slurry which tend to become geometrically incorporated within the composite mat, rather than to become junction points which weaken the structure. Therefore, the extra steps sometimes employed in cleaning processes to remove the adhered shot are not necessary in the present cleaning process for the mineral wool fraction. Since such process steps may cause excessive breakage of the fibers, they are generally undesirable.

The present process is commercially advantageous, since the loose non-fibrous contaminants are, by the described two-stage process, separated from the mineral wool. Accordingly, when the mat is formed on the forming screen, the water drawn through the screen for recirculation into the system does not contain loose contaminants and, therefore, does not have to be cleaned and will not foul the system upon recirculation. As such, the present invention may be carried out in a high-speed, continuous mat producing process such as is presently employed in the commercial production of fiberglass mat shingles.

For a better understanding of the invention, and for purposes of illustration, but not of limitation, reference is made to the following detailed description of the preferred embodiment, taken in conjunction with the drawings accompanying the application.

DETAILED DESCRIPTION OF THE PREFERRED EMBODIMENT

Figure 1:
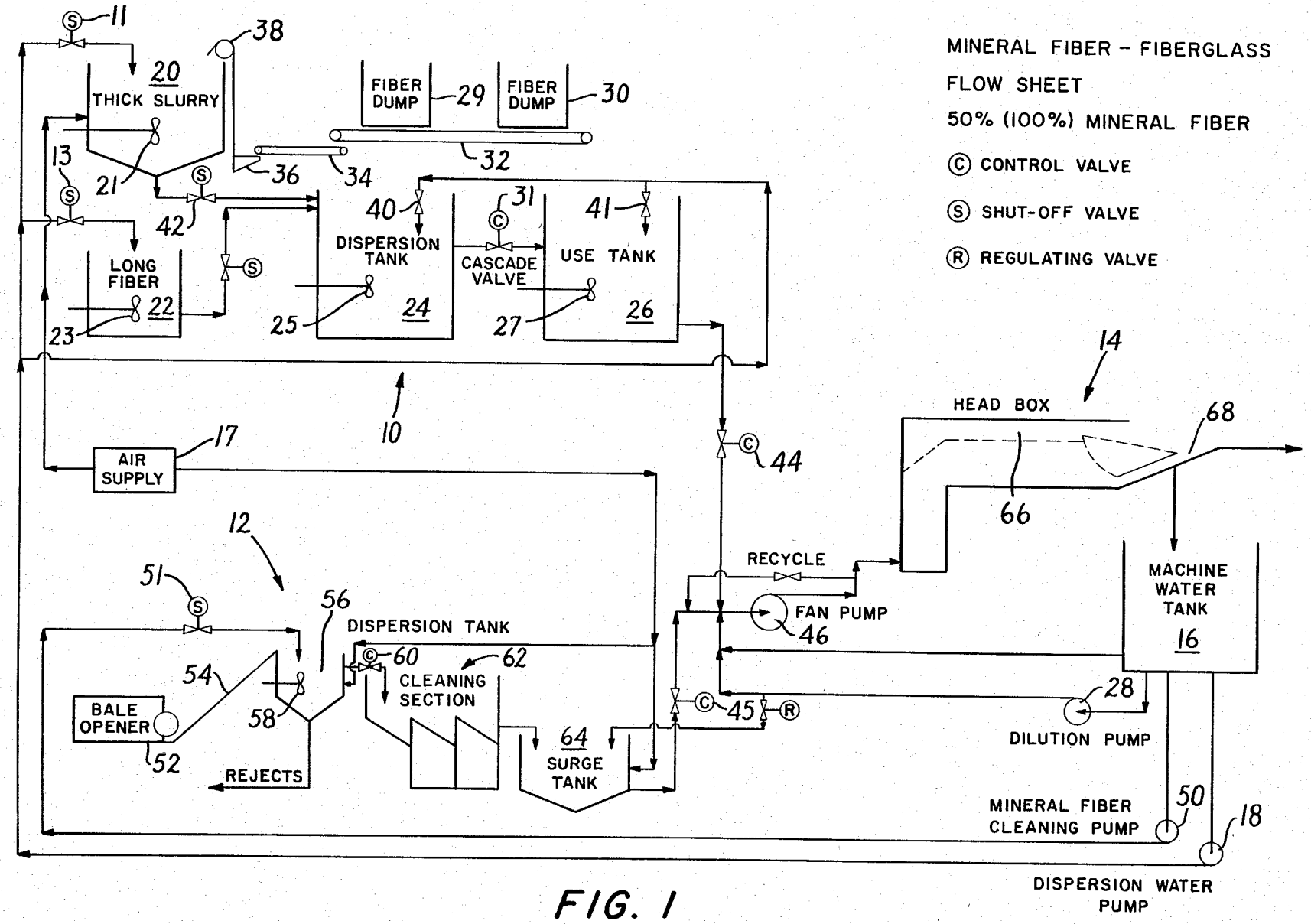
FIG. 1 is a schematic view of apparatus for carrying out the process according to the present invention and for forming the novel composite fiberglass/mineral wool mat in accordance with the preferred embodiment.

In the description which follows like parts are marked throughout the specification, as well as in the drawings, with the same reference numerals. The drawings are not necessarily to scale and, in some instances, portions or elements have been exaggerated in order to depict more clearly certain features of the invention.

Referring now to FIG. 1 of the drawings, a two stage, continuous process is shown for the production of a composite mat containing mineral wool fibers and fiberglass, wherein the ratio of the respective fibers can be varied up to 100% of either fiber, but preferably up to about 40–65% mineral wool. The first or pre-processing stage involves the simultaneous, but separate, processing of the fiberglass and mineral wool fractions prior to admixture for forming the composite mat. The second or forming stage involves the forming of mat or sheet by conventional means using the fiber admixture from the pre-processing stage. Section 10 depicts a combination of dilution and dispersion tanks and control and agitation means which comprise the pre-processing system for the fiberglass fraction of the composite. Section 12 depicts pre-processing equipment, including dilution and dispersion tanks, control and agitation devices, as well as cleaning apparatus for the mineral wool fraction. The second or mat forming stage 14 is shown as a conventional wet-laid mat forming apparatus.

As best seen by reference to the schematic of FIG. 1, process water is supplied from the machine water tank 16. The dispersion water pump 18 feeds process water to the thick slurry tank 20 via valve 11 in section 10 for pre-processing the fiberglass fraction. Process water is also discharged selectively from the machine water tank 16 via dispersion water pump 18 through valve 13 to a long fiber pre-dispersion tank 22 the purpose of which is to disperse the longer fibers at a lower agitation than shorter fibers. This is to keep or reduce the clumping tendency normally experienced if long and short fibers are slurried at the same time. Process water may also be discharged to either dispersion tank 24 or use tank 26. The purpose of the dispersion tank 24 is to reduce the consistency, i.e. fiber solids, in preparation for feeding the slurry to the inlet side of fan pump 46. Reducing the consistency, which is easier to accomplish in a stepwise fashion, helps to keep the dispersion more uniform. The use tank 26 is kept at a constant level thereby maintaining a uniform head pressure to the fibre control valve 44 of the fan pump 46 and, in turn, similarly maintaining the profile of the basis weight across and in the machine direction of the mat. Each of the tanks 20, 22, 24 and 26 is suitably equipped with a variable agitation device 21, 23, 25 and 27.

Fiberglass is introduced into the system of section 10 for pre-processing via a series of fiber dump systems 29 and 30 in any combination of fiber lengths and diameters as may be desired. With regard to the introduction of the glass fiber, where long fibers, i.e. greater than $\frac{3}{4}$ inch, are introduced into the pre-processing system, this is accomplished via the long fiber pre-dispersion tank 22, with the remaining shorter fibers fed directly into the thick slurry tank 20. Glass fiber from either or both fiber dump systems 29 and 30 is metered onto a conventional conveyor system 32, 34. The glass fiber then drops into the bucket 36 of a skip hoist 38 which is activated by a load sensing system (not shown). When the proper and desired amount of fiber has been deposited in the bucket, the load sensing system is activated and the glass fiber is dumped into the thick slurry tank 20, the tank 20 having been pre-filled with machine water. Glass fiber in the thick slurry tank 20, as well as in the long fiber tank 22, are gently separated by agitators 21, 23, as well as by compressed air from air supply 17. When the slurries are suitably prepared, generally about 0.75–1% consistency, they are emptied into the dispersion tank 24. Level probe 40 is suitably located within the dispersion tank 24 and are set to cause the thick slurry tank dump valve 42 to open when the level in the dispersion tank 24 drops below a designated point.

Dispersed fiber from the dispersion tank 24 is allowed to cascade via valve 31 to use tank 26 and, thereafter, from tank 26 via fiber control valve 44 to the suction side of the fan pump 48. The level of tank 26 is maintained by probe 41 within a narrow range, such that the flow through control valve 44 is held substantially constant. Thus, the need for fiber feed pumps is eliminated.

Operational sequencing throughout the process and within the various sections and stages is accomplished by known techniques through a conventional system of timers and weight and level detectors which is only partially shown.

Simultaneously with the pre-processing of the fiberglass fraction as just described, the mineral wool fraction is also pre-processed by dispersing, cleaning and slurrying in section 12. Process water is supplied to the mineral wool cleaning system from the machine water tank 16 via mineral fiber pump 50. The pump 50 is a standard centrifugal pump which delivers or moves water from one tank to another via valve 51. Mineral wool is introduced into the pre-processing section 12 by placing a bale of mineral wool in the bale opener 52 where it is opened and broken up. The partially shredded mineral wool fiber is then fed via a conveyor system 54 to the dispersion tank 56.

Figure 2:
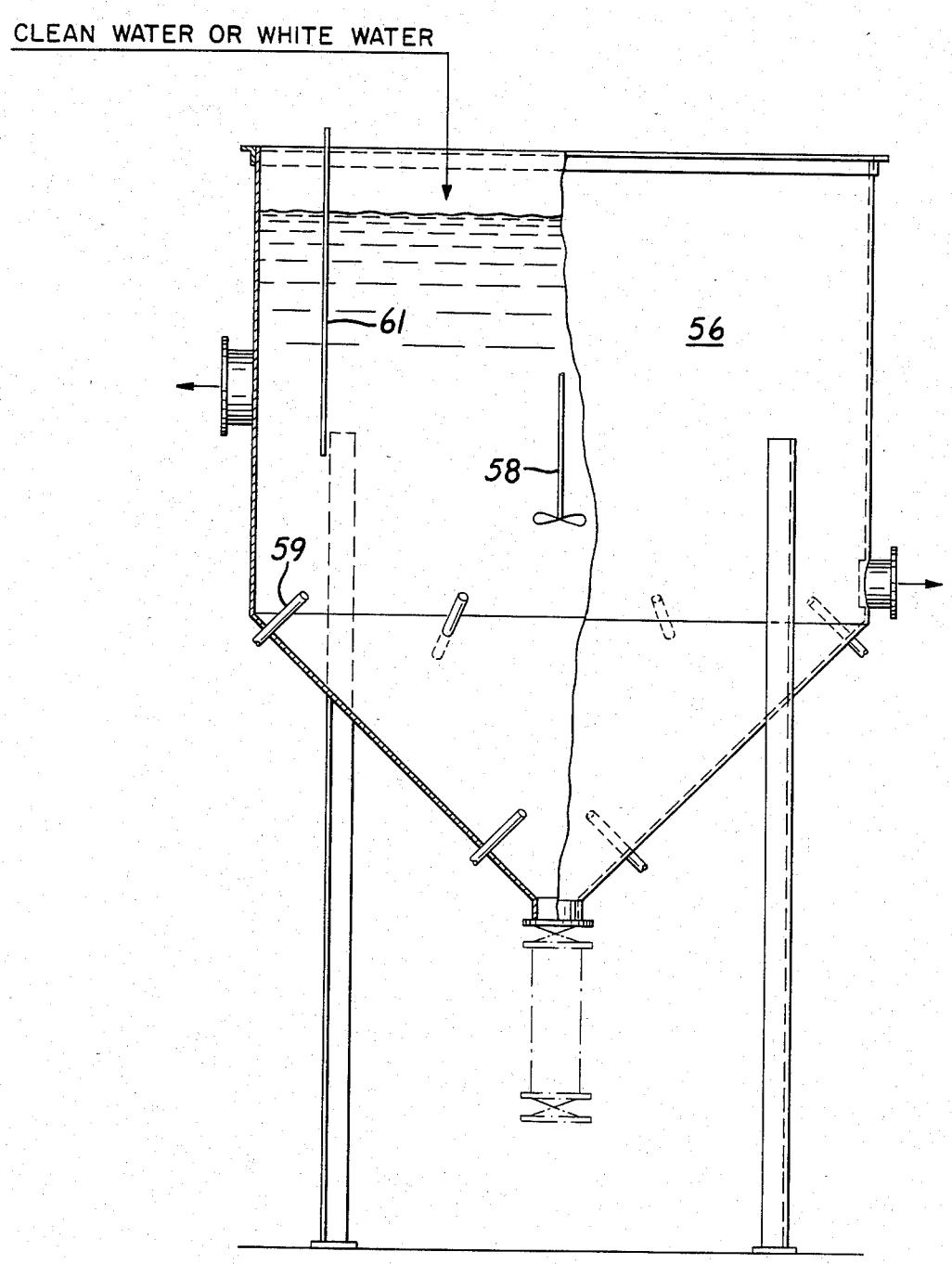
FIGS. 2 and 2A are side and top sectional views, respectively, of the pre-processing dispersion tank for the mineral wool fraction in accordance with the process of the preferred embodiment.
Figure 2A:
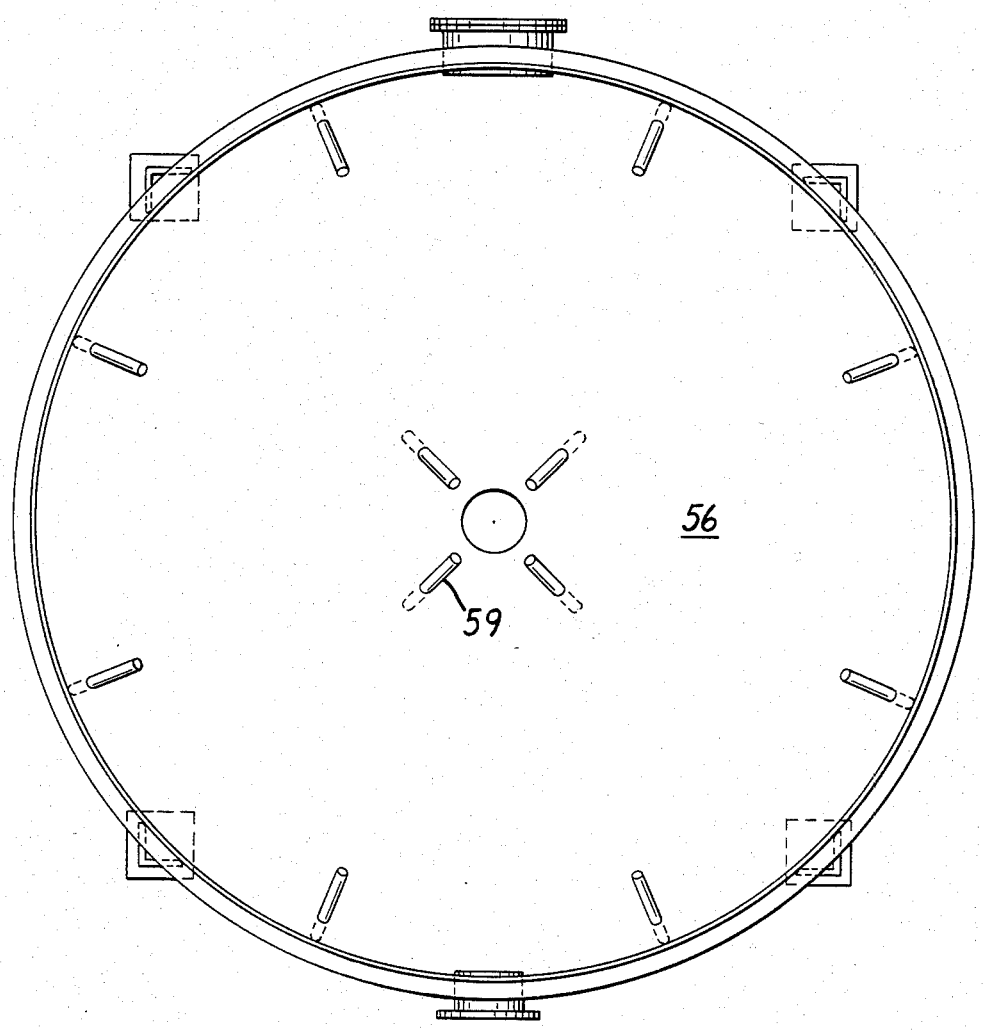

As seen in FIGS. 2 and 2A, in the dispersion tank 56, the fiber is partially cleaned through agitation (agitator 58) and a system of air tumbling the fiber, provided by air jets 59 connected to compressed air source 17. The flow rate and consistency within the agitated dispersion tank 56 are regulated by the amount of machine water and mineral wool fiber introduced. The partially cleaned mineral wool fiber then passes from tank 56 around baffle 61 via valve 60 to and through the cleaning section 62, where by means of a system of baffles and air tumblers, best understood by reference to the drawing and description of FIGS. 3–5, the remainder of the unfiberized loose material is separated and removed. The purpose of baffle 61 is to keep the vortex induced by the agitator at a low level, help disperse the wool fibers easily, and ensure that the wool chunks and partially shredded material is uniformly dispersed before leaving this unit. It is constructed as follows: a plate of steel mounted eccentrically across the diameter of the dispersing tank, protruding above the water level and below the outlet orifice so as to aid fiber dispersion. The mineral fiber slurry obtained from the cleaning section 62 then flows to a surge tank 64, where further water may be added to adjust the consistency of the slurry, and then via control valve 45 to the suction side of the fan pump 46, where the mineral wool slurry mixes with the fiberglass slurry in a pre-determined, desired proportion.

Referring again to FIG. 1, the dilution water pump 28, which takes its suction from the flow of process water through machine water tank 16, supplies dilutant as necessary to the mineral fiber surge tank 64 and to the suction side of the fan pump 46, to provide additional dilution of the composite slurry.

The composite slurry is, thereafter, continuously pumped via the fan pump 46 to the head box 66 and in turn continuously fed to a moving forming screen 68 of a conventional arrangement. The composite fiber mat is, thereafter, removed from the forming screen 68 and sent to a binder section for the application of a binder appropriate for the end use of the mat.

Figure 3:
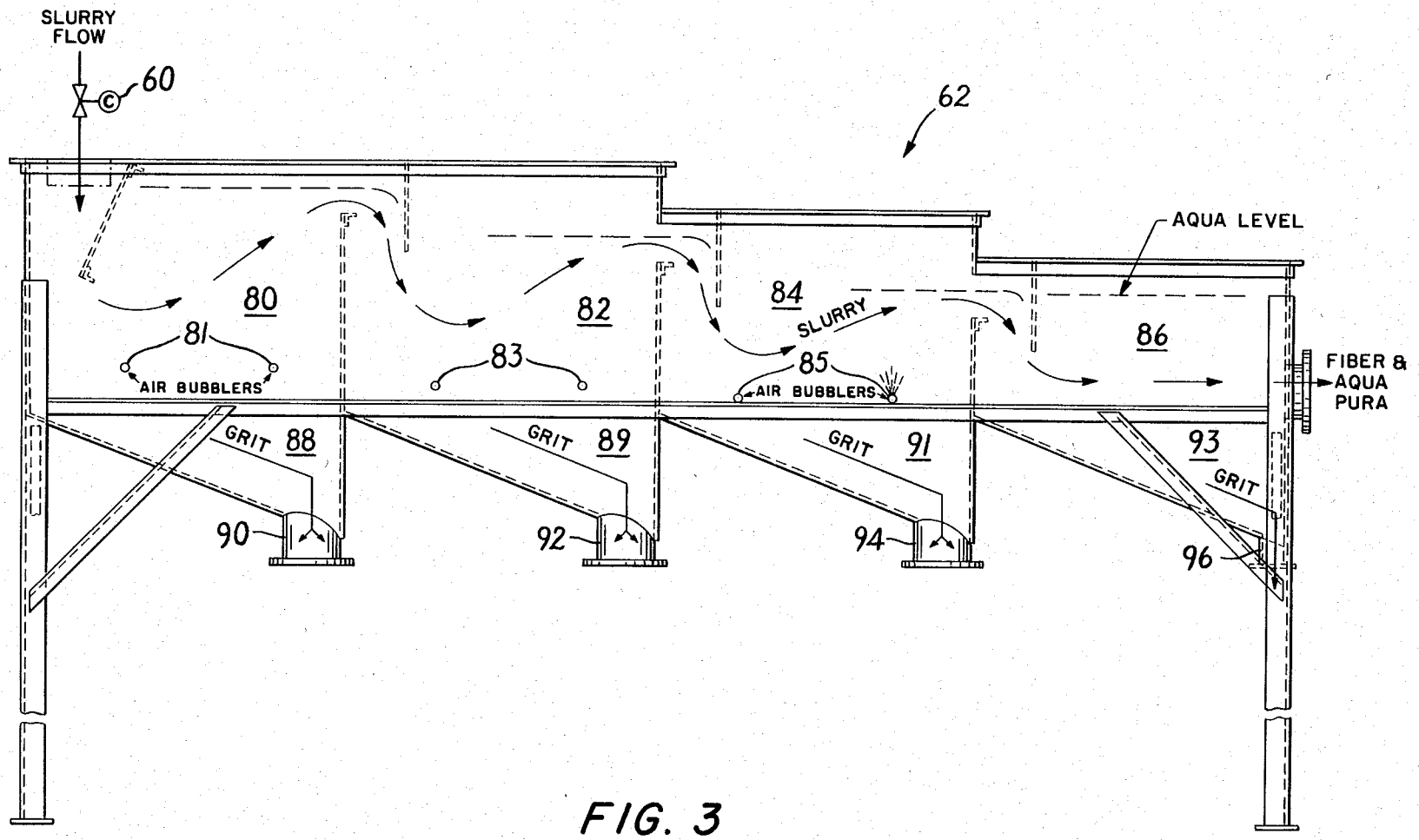
FIG. 3 is a side, sectional view of the mineral wool cleaning apparatus of the present invention and as employed in the preferred embodiment as illustrated in FIGS. 1 and 2.
Figure 4:
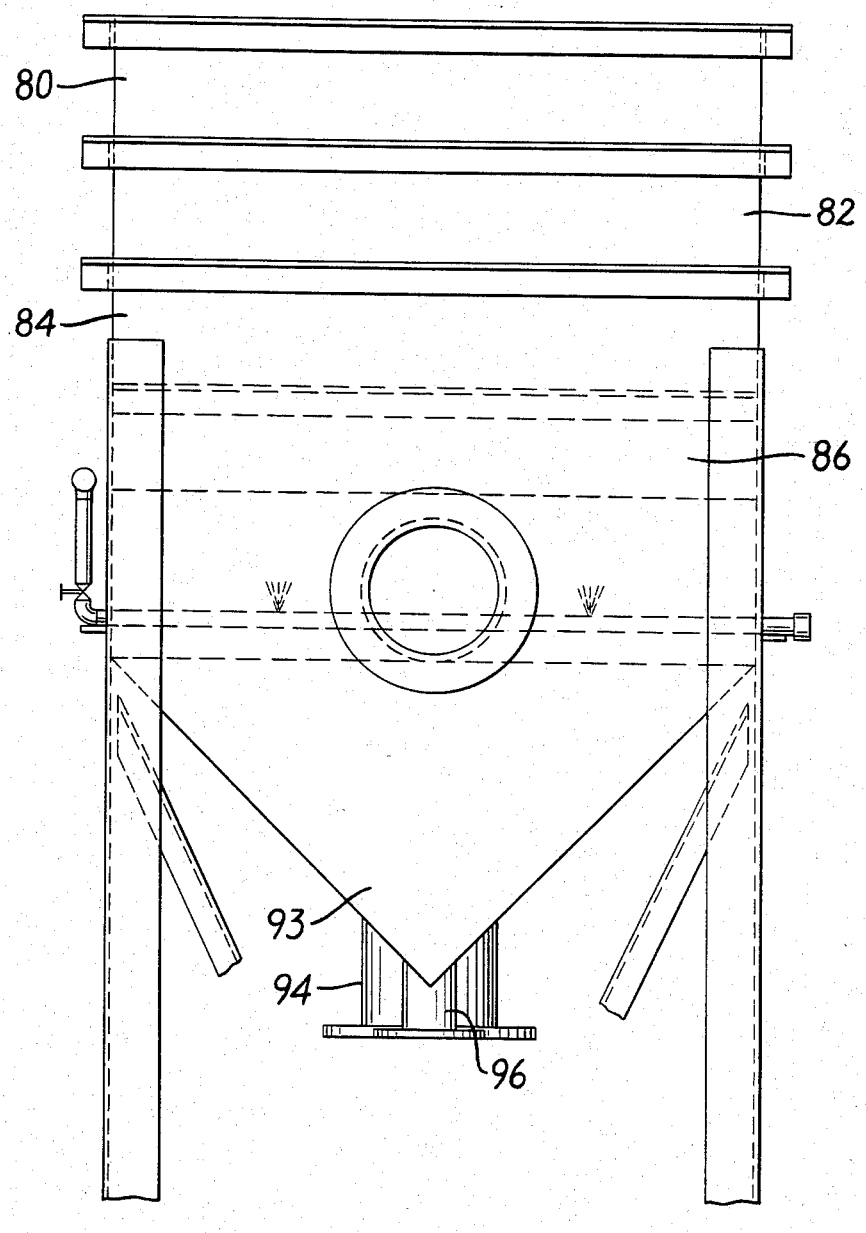
FIG. 4 is an end view of the mineral wool cleaning apparatus shown in FIGS. 1 and 3.
Figure 5:
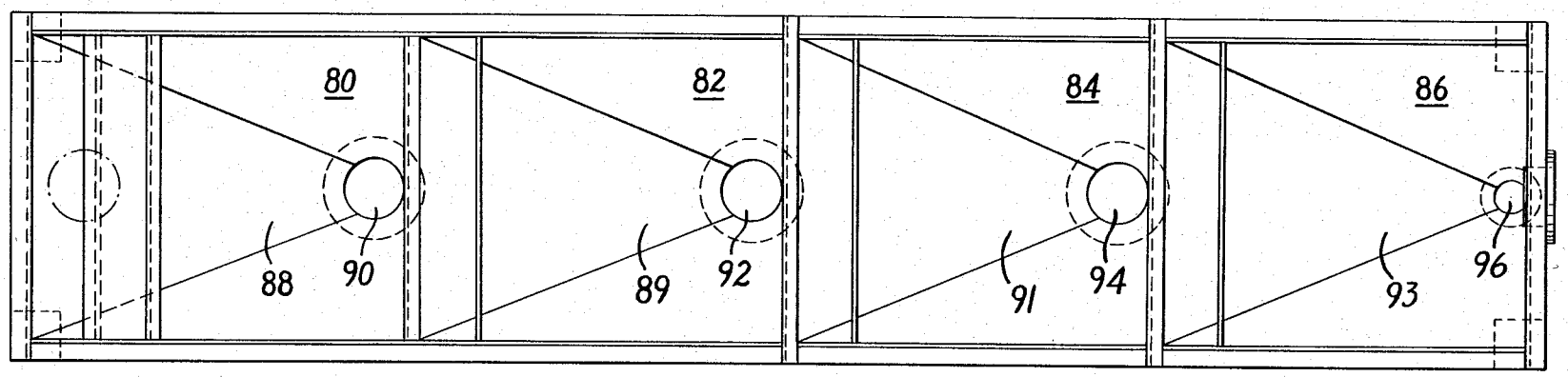
FIG. 5 is a top, plan view of the mineral wool cleaning apparatus as shown in FIGS. 1, 3 and 4.

As best seen in FIGS. 3–5, the cleaning section 62 comprises a cascaded baffle arrangement wherein the mineral wool slurry from dispersion tank 56 enters the cleaning system via valve 60 and passes through a series of baffle chambers 80, 82, and 84 under low air turbulence caused by the action of air bubblers 81, 83 and 85, respectively, located within the said chambers, and finally passes through exit chamber 86. As the aqueous mineral wool slurry from tank 56 enters the chamber 80, it is subjected both (i) to laminar flow and to air turbulence such that the slurry cascades through the baffle chambers and (ii) to air turbulence, such that at least a portion of the grit and any other remaining non-fibrous, particulate contaminants, having a different weight and configuration than the usable fiber portion of the slurry, are caused to separate and drop to the bottom 88 of the chamber 80 or adhere to the surfaces of the chamber 80. The slurry is similarly treated in chambers 82 and 84 such that by the time the slurry reaches chamber 86 any residuum of grit is separated and a substantially clean mineral wool fiber is delivered to the surge tank 64 for slurrying and further treatment. The dump valves 90, 92, 94 and 96 are periodically used to clean the chamber of separated and collected contaminants.

In FIG. 5, a top plan view shows the relative arrangement of the chambers 80, 82, 84 and 86 and the funnel configuration of the respective bottom sections 88, 89, 91 and 93 for catching and funneling the grit to the respective dump valves 90, 92, 94 and 96.

While the invention has been described with reference to certain embodiments thereof, it will be understood by those skilled in the art that other obvious embodiments as well as certain changes and modifications within the scope of the teachings of this specification are contemplated. Accordingly, the invention shall be limited only by the proper scope of the appended claims.

What is claimed is:

1. A method for producing an improved inorganic fiber mat which comprises the steps of:

(a) forming an aqueous slurry of an inorganic fiber raw material, at least a portion of which is mineral wool, which raw material is only partially fibrous in form and contains non-fibrous, particulate contaminants including heavy, non-fibrous inorganic particulate material;

(b) agitating the said aqueous slurry under controlled agitation conditions so as to separate said heavy, non-fibrous inorganic particulate material;

(c) passing the previously agitated slurry through a cleaning system comprising a series of baffle chambers, wherein the moving slurry is cascaded and subjected to air-induced hydraulic turbulence, said air being injected into each chamber to create turbulence sufficient to separate the remaining non-fibrous, inorganic particulate contaminants from the inorganic fibers within said chambers; and (d) thereafter transferring the said fibrous slurry to a mat forming device, on which said fibrous slurry is wet laid to form said mat.

2. A method for producing an inorganic fiber composite mat containing mineral wool and fiberglass which comprises the steps of:

(a) pre-processing a mineral wool fraction containing substantial amounts of non-fibrous, particulate contaminants so as to separate and remove such contaminants by (i) forming an aqueous slurry of mineral wool wherein the mineral wool is only partially fibrous in form and contains non-fibrous, particulate contaminants, including heavy, non-fibrous inorganic particulate material;

(ii) agitating the said aqueous slurry under controlled agitation conditions so as to separate said heavy, non-fibrous inorganic particulate material; and (iii) passing the said mineral wool slurry through a cleaning system comprising a series of baffle chambers, wherein the moving slurry is cascaded and subjected to air turbulence, said air being injected into each chamber to create turbulence sufficient to separate the remaining non-fibrous, inorganic particulate contaminants from the mineral wool fibers within said chambers;

(b) simultaneously pre-processing the fiberglass fraction by dispersing and forming an aqueous slurry of the glass fibers in water;

(c) admixing the cleaned fibrous mineral wool slurry and the fiberglass slurry in a desired, pre-determined proportion; and (d) thereafter transferring the said admixture to a mat forming device, on which said admixture is wet laid to form a mat.

3. A method according to claim 2 wherein the composite mat comprises about 40–65% mineral wool.

* * * * *